United States Patent [19]

Kanno et al.

[11] Patent Number: 4,714,921

[45] Date of Patent: Dec. 22, 1987

[54] DISPLAY PANEL AND METHOD OF DRIVING THE SAME

[75] Inventors: Hideo Kanno; Shinichi Yamashita, both of Kawasaki; Masahiko Enari, Yokohama; Mitsutoshi Kuno, Kawasaki; Atsushi Mizutome, Kanagawa, all of Japan

[73] Assignee: Canon Kabushiki Kaisha, Tokyo, Japan

[21] Appl. No.: 823,731

[22] Filed: Jan. 29, 1986

[30] Foreign Application Priority Data

Feb. 6, 1985 [JP] Japan ..... 60-19879

[51] Int. Cl.[4] ..... G09G 3/00

[52] U.S. Cl. ..... 340/784; 340/805

[58] Field of Search ..... 340/784, 805

[56] References Cited

U.S. PATENT DOCUMENTS

| | | | |
|---|---|---|---|
| 4,367,924 | 1/1983 | Clark et al. | 350/346 |
| 4,586,039 | 4/1986 | Nonomura et al. | 340/784 |
| 4,649,383 | 3/1987 | Takeda et al. | 340/784 |
| 4,656,470 | 4/1987 | Saka | 340/784 |

*Primary Examiner*—Howard A. Birmiel

*Attorney, Agent, or Firm*—Fitzpatrick, Cella, Harper & Scinto

[57] ABSTRACT

A liquid crystal display panel comprising: a liquid crystal display section; an array section of switching elements connected to first information signal lines of the liquid crystal display section, respectively; a driving circuit section which divides the switching element array section into a plurality of blocks and time-sharingly drives these blocks on a block unit basis; second information signal lines of wirings as many as the number of switching elements of one block among those blocks being connected to the driving circuit section; an information signal output circuit for applying an information signal to the second information signal lines; and an arithmetic operating circuit for correcting the information signal which is applied to the second information signal line in the previous block near the next block between the previous block which is previously driven and the next block which is driven next when the panel is time-sharingly driven for every block to an information signal to eliminate a high luminance which is produced in the first information signal line connected to this second information signal line.

15 Claims, 6 Drawing Figures

DISPLAY PANEL AND METHOD OF DRIVING THE SAME

BACKGROUND OF THE INVENTION

1. Field of the Invention

The present invention relates to a liquid crystal display panel and a method of driving this panel and, more particularly, to a correction driving method for a liquid crystal display panel which uses a thin film transistor (TFT) as a switching element for driving block-divided pixels and is time-sharingly driven, whereby a high luminance line for every block which is generated when this panel is driven at an inversion period of one horizontal period is eliminated.

2. Description of the Prior Art

In a conventional liquid crystal display panel (i.e., LCD panel) which uses a TFT as a switching element for driving block-divided pixels and is timesharingly driven, an active matrix circuit substrate necessary to drive and a TFT active matrix circuit substrate of a display section are constituted on the same substrate. FIG. 3 is a schematic arrangment diagram showing an example of such an LCD panel. As two fundamental circuits to matrix-drive a display section P, a gate line driver G and a source line driver D are arranged. Further, a block-dividing TFT array 1 is provided for a matrix circuit 2 from the source line driver D. The TFT array 1 is driven by a TFT array driver B. The portion surrounded by a broken line in the diagram, namely, the display section P, TFT array 1, and matrix circuit 2 are constituted on the same substrate.

FIG. 4 is a wiring diagram showing in further detail the portion on the same substrate mentioned above. In FIG. 4, output lines $D_1$, $D_2$, $D_3$, . . . , $D_m$ from the source line driver D, which is the video output circuit, are combined as one block on an m-line unit basis of the output lines by the matrix circuit 2. When it is assumed that the number of blocks is k, (m×k) video signal lines are obtained due to the matrix of m×k. The respective blocks are combined to m video signal lines $S_1$, $S_2$, $S_3$, . . . , $S_m$ by output lines $B_1$, $B_2$, . . . , $B_k$ from the TFT array driver B, respectively. The video signal lines $S_1$ to $S_m$ are grounded through holding capacitors C. A pixel U of a liquid crystal cell indicated by O in the diagram is arranged in each cross point of the matrix consisting of the (m×k) video signal lines and output lines $G_1$, . . . , $G_{m-1}$, $G_m$ from the gate source driver G.

When the above-mentioned LCD panel is driven at the inversion period of one horizontal period, a charge shift phenomenon called a charge sharing effect occurs in the boundary portion between the divided blocks, namely, between the video signal lines $S_m$ and $S_1$ in FIG. 4 due to the capacitive component between the source lines. Thus, a voltage of ΔV as much as the amount of this effect is added to the video signal on the signal line $S_m$ and a signal of a voltage amplitude larger than the inherent video signal is outputted. (The opposite electrodes are grounded).

The principle of the charge sharing effect will then be described hereinbelow with reference to FIGS. 5 and 6. FIG. 5 is a principle diagram of the charge sharing effect and FIG. 6 is a time chart thereof. In FIG. 5, an alternate long and short dash line at the center of the diagram indicates a boundary between the blocks and the left hand of the alternate long and short dash line assumes the first block and the right hand assumes the second block. For the last signal line $S_m$ in the first block, an output from the last source line $D_m$ is driven by a first block driving voltage $B_1$ by the block dividing TFT. For the first signal line $S_1$ in the second block, an output of the first source line $D_1$ is driven by a second block driving voltage $B_2$ by the block dividing TFT. Source line capacitances $C_m$ and $C_l$ with respect to source terminals of the respective block dividing TFTs correspond to the video signal holding capacitor C. A capacitance $C_{ss}$ between the lines to cause the voltage ΔV exists between the source lines. As shown in FIG. 6, when a gate pulse is inputted to $B_1$, the video signal $D_m$ is transmitted to $S_m$ through the channel of the TFT, namely, it is charged in $C_m$. After the source lines in the first block to which $C_m$ belongs have been completely charged, a pulse is then inputted to $B_2$ and the source lines including $S_1$ which belong to the second block are charged. At this time, charging waveforms of $S_m$ and $S_1$ arranged in the boundary portion of two blocks change as shown in FIG. 6. The amplitude ΔV which is indicated by the hatched portion in FIG. 6 is added to $S_m$, so that $S_m$ is larger than the inherent video signal. On one hand, a waveform of $S_1$ fluctuates as shown by the hatched portion in the diagram at the early time of inversion. Such a phenomenon occurs since the capacitance $C_{ss}$ between the source lines produces the charge sharing effect between $C_m$ and $C_l$. The relation between ΔV and V is approximated by the following expression ($C=C_m \approx C_1$)

$$V \approx C_{ss}/C + C_{ss} \cdot V(v)$$

When the foregoing LCD panel is driven without performing any correction, the last $S_m$ line is observed by the eyes as the high luminance line for every block, resulting in a fairly inconvenient as a display.

SUMMARY OF THE INVENTION

The present invention is made to solve the above-mentioned problem, namely, to eliminate such a high luminance line.

It is an object of the invention to provide a liquid crystal display panel which can solve the above-mentioned problem.

Another object of the invention is to provide a method of driving a liquid crystal display panel whereby the high luminance line which is generated due to the charge sharing effect is eliminated by an external correcting circuit without needing any modification of the panel side and the block division drive is realized when the LCD panel is driven at the inversion period of one horizontal period.

Namely, the present invention has the first feature with respect to the liquid crystal display panel comprising: a liquid crystal display section; an array section of switching elements connected to each of first information signal lines of the liquid crystal display section; a driving circuit section which divides the array section of the switching elements into a plurality of blocks and time-sharingly drives the blocks on a block unit basis; second information signal lines of wirings as many as the number of switching elements of one block among those blocks being connected to the driving circuit section; an information signal output circuit to apply an information signal to those second information signal lines; and an arithmetic operating circuit for correcting the information signal which is applied to the second information signal line in the previous block near the next block between the previous block which is previously driven and the next block which is driven next when the panel is time-sharingly driven for every block to an information signal which eliminates a high luminance which is generated in the first information signal line connected to this second information signal line.

The invention has the second feature with respect to the method of driving a liquid crystal display panel comprising: a liquid crystal display section; an array of switching elements for sampling/holding which are arranged on the side of video signal lines of the liquid crystal display section by a quantity as many as the number of these video signal lines; an active matrix circuit which divides the switching element array into a plurality of blocks and time-sharingly drives these blocks; and an external video signal output circuit of output lines as many as the number of signal lines of one block of the switching element array, whereby when this liquid crystal display panel is driven in an alternating current manner at an inversion period of one horizontal period of the liquid crystal display panel, the video signal which is subjected to an arithmetic operating process to eliminate a high luminance line for every block which is produced in the video image is outputted to the signal lines from the external video signal output circuit.

DETAILED DESCRIPTION OF THE PREFERRED EMBODIMENT

In this invention, to solve the abovementioned problem, there is provided means for embodying a method of driving a liquid crystal display (LCD) panel comprising: an LCD section which is constituted by a thin film transistor (TFT) active matrix circuit substrate; an array of switching elements for sampling/holding which are arranged on the side video signal lines of the LCD section by a quantity as many as the number of video signal lines; an active matrix circuit which divides the switching element array into a plurality of blocks and time-sharingly drives these blocks; and an external video signal output circuit of output lines as many as the signal lines of one block of the switching element arrays, whereby when the LCD panel is driven in an alternating current manner at an inversion period of one horizontal period of the LCD panel, an arithmetic operating process to eliminate a high luminance line for every block which is produced in the video image is performed for the video signal by the external video signal output circuit, thereby performing the correction.

Figure 2:
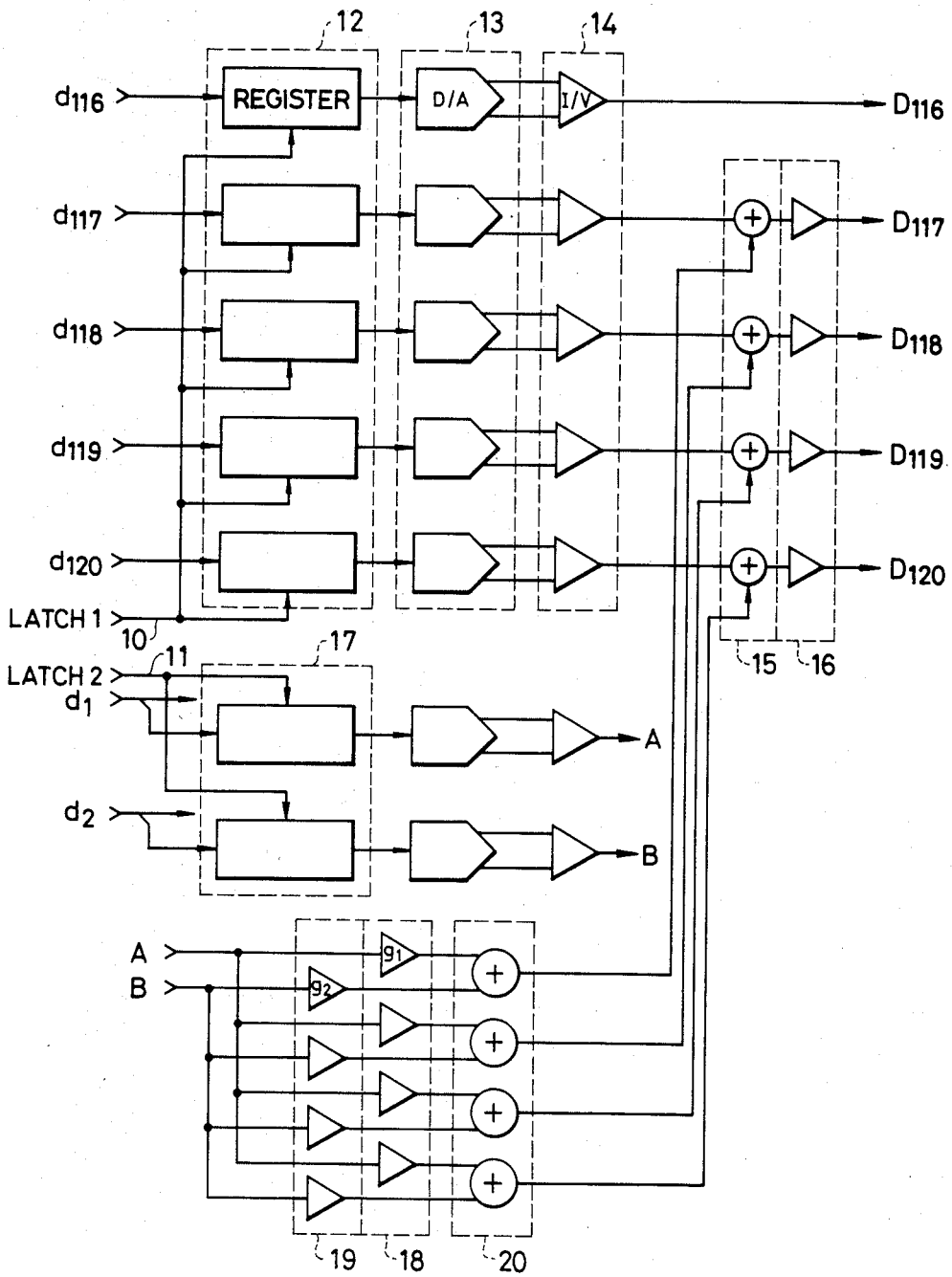
FIG. 2 is a partial circuit diagram of an embodiment of invention.
Figure 3:
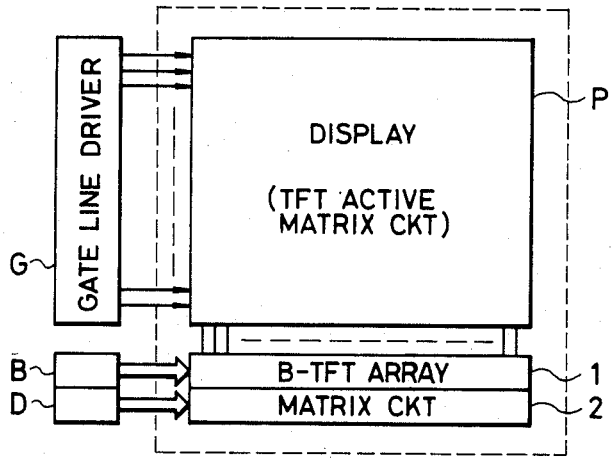
FIG. 3 is an arrangement diagram of a conventional example.
Figure 4:
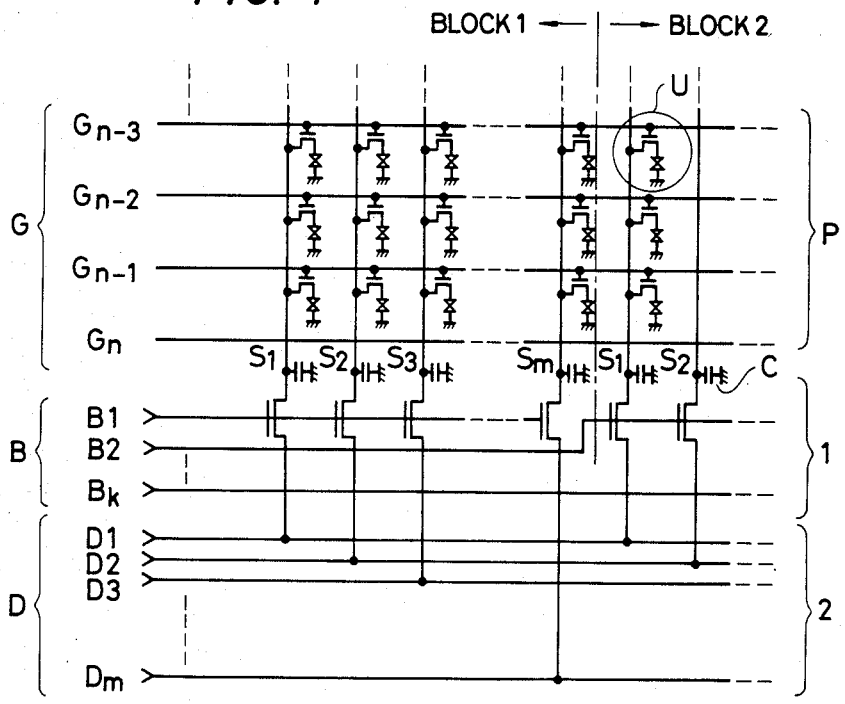
FIG. 4 is a partial circuit diagram of FIG. 3.
Figure 5:
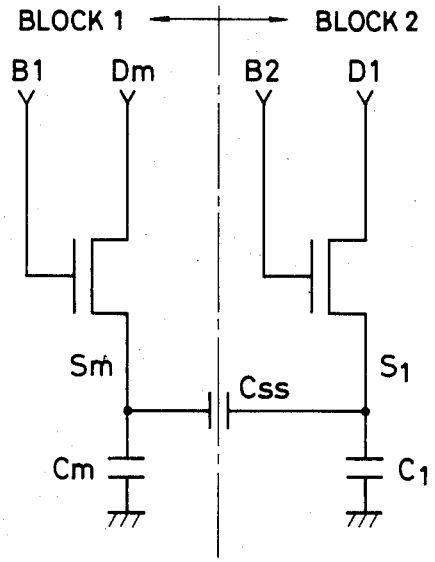
FIG. 5 is a principle diagram of a charge sharing effect.
Figure 6:
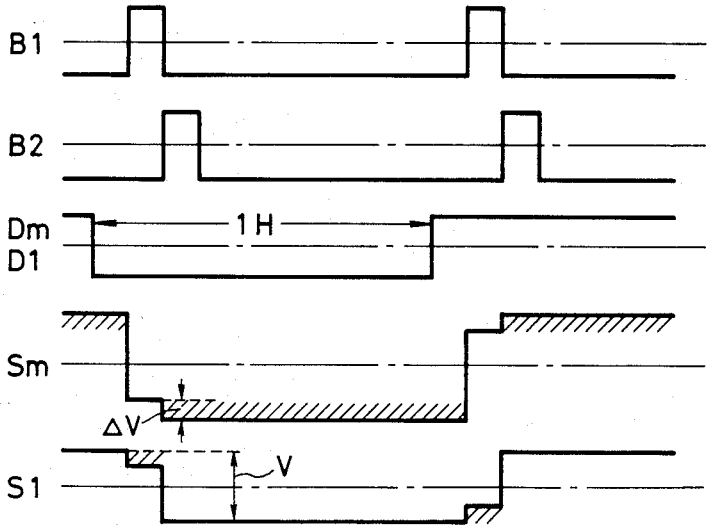
FIG. 6 is a time chart of FIG. 5.

The arithmetic operating process is perfomed by connecting a subtractor to the last signal line of the source driver. In the embodiment, since the source driver is constituted by a digital/analog converter as shown in FIG. 2, a digital register is used. However, the register is not limited to the digital register but the correcting circuit can be realized by another register.

In the case of using an all analog source driver, the register may be realized by use of a sampling/holding capacitor.

The magnitude of $\Delta V$ due to the charge sharing effect is proportional to a voltage V of the adjacent block as mentioned above.

$$\Delta V = C_{ss}/C + C_{ss} \cdot V$$

Since the voltage V fluctuates due to the video signal which is outputted to the adjacent block, the value of V is estimated from the value of V of the first signal line and when this estimated value is outputted to the relevant block, the estimated value is subtracted from the value of V. In this way, the high luminance line can be eliminated in principle.

The present invention will be described in detail hereinbelow with reference to an embodiment and its drawings.

Figure 1:
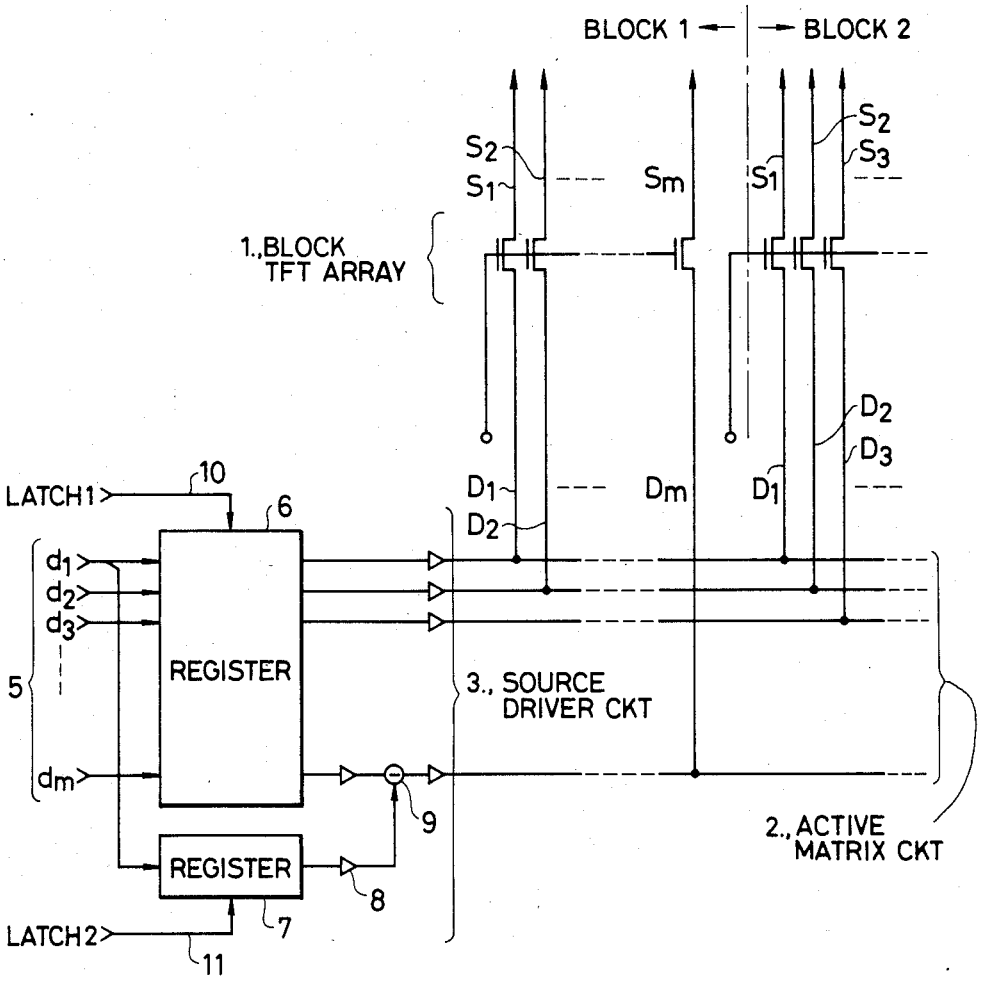
FIG. 1 is an arrangement diagram showing a fundamental principle of the present invention.

FIG. 1 is a partial arrangement diagram showing a fundamental example of a correcting circuit suitable to embody the invention. In FIG. 1, reference numeral 1 denotes the block dividing TFT array; 2 is the active matrix circuit; 3 a source driver circuit; and 4 an output stage thereof. Video data $d_1, d_2, d_3, \ldots, d_m$ from an external video output circuit 5 are temporarily stored in a first register 6 and the first video data $d_1$ is also temporarily stored in a second register 7. An output of the second register 7 is adjusted by a gain control circuit 8 and thereafter it is used to arithmetically operate an output of the last video data $d_m$ of the first register 6 by a subtractor 9. A latch pulse 10 is used to manage the timings when the video data $d_1$ to $d_m$ are stored into the first register 7. Another latch pulse 11 is used to manage the timing when the first video data $d_1$ is stored into the second register 7.

The charge sharing effect occurs in the video signal lines $S_m, S_{m-1}, \ldots$ in the first block and its phenomenon occurs in the signal lines $S_1, S_2, \ldots$ in the second block. When the video signals $D_1$ to $D_m$ are outputted from the active matrix circuit 2 to the first block of the TFT array 1, the video data $d_1$ to be outputted to the second block has already been determined by the source driver circuit 3. This data $d_1$ is supplied to the output stage of $d_m$ and a gain g of an amount corresponding to $\Delta V$ is produced by the gain control circuit 8. The gain g is subtracted from $d_m$ to obtain the video signal $D_m$. Then, by outputting $D_m$ to the last line $S_m$ in the first block, a desired correction driving method can be realized.

As a practical example, a liquid crystal display panel of a scale consisting of, e.g., 240 horizontal scanning lines (gate lines) $\times$480 vertical lines (source lines) is used. This panel size corresponds to the size of about three inches of the television screen. Now, assuming that the number of divided blocks of the source lines is four, the number of lines in one block becomes 120 and the wiring circuit of the active matrix has 120 lines. In addition, the number of common gate lines of the block dividing TFT array consists of four bits. A color television signal is used as a video source and it is assumed that a full color television video signal is outputted to the panel.

FIG. 2 is a partial circuit diagram showing an example of the correcting circuit section of the embodiment. In FIG. 2, reference to numeral 12 denotes a first register; 13 a digital/analog converter; 14 an inverter; 15 a subtractor; 16 an output steps; 17 a second register; 18 and 19 are gain controllers; and 20 an adder. The first register 12, second register 17, and subtractor 15 correspond to the first register 6, second register 7, and subtractor 9 in FIG. 1. The gain control circuit 8 in FIG. 1 is constituted by two gain controllers 18 and 19 and adder 20.

To execute the correction, assuming than m=120, it is necessary to know at which ratio the respective signal lines $S_1$, $S_2$, . . . in FIG. 1 preliminarily exert the influence of the charge sharing effect on the respective signal lines $S_{120}$, $S_{119}$, . . . in the adjacent block. The gain ratio of the gain control circuit 8 must be adjusted in dependence on the result.

According to the result of experiments, it has been found that a degree of influence of V which is exerted to the video signal lines $S_{120}$, $S_{119}$, . . . in a certain block by the video signal lines $S_1$, $S_2$, . . . in the adjacent block is such that 80% of the degree of influence is given by $S_1$ and the remaining 20% is given by $S_2$. In addition, a range of about four lines was influenced, namely, $S_{120}$ to $S_{117}$ were influenced. Therefore, it is sufficient that the correcting circuit is connected to the video signal lines $D_{120}$ to $D_{117}$ and the gain of the subtraction amount is adjusted to a ratio of 8:2 from $d_1$ and $d_2$ and the added output is corrected by the subtractor, thereby performing the correction.

Although the video signal of the digital value was fed back and used for the estimation data in the embodiment, the invention is not limited to this method. Even if a video signal of an analog value is used as well, it can be fed back by providing a sampling/holding capacitor to the analog output stage.

In the invention, for example, a twisted nematic liquid crystal element may be used as a liquid crystal. However, in addition to this element, it is also possible to use a ferroelectric liquid crystal element which appears as a chiral smectic phase (e.g., C phase, H phase, or the like) having no spiral structure which is disclosed in U.S. Pat. No. 4367924.

As described above, according to the present invention, it is possible to provide a liquid crystal panel driving method whereby when the LCD panel is driven at the inversion period of one horizontal period, even if the capacitance $C_{ss}$ between the source lines exists in the panel, the block division drive can be realized without causing any high luminance line in the line near the boundary of the blocks. Further, there is no need to particularly rearrange the wiring and constitution to reduce the capacitance $C_{ss}$ between the lines. Also, this correcting circuit can be realized by merely slightly modifying a circuit scale in association with production of an IC of the driver. Therefore, there is a very economical effect since the manufacturing costs hardly increase.

What we claimed is:

1. A liquid crystal panel comprising:

a liquid crystal element section;

an array section of switching elements connected to first information signal lines of said liquid crystal element section, respectively;

a driving circuit section which divides said array section of said switching elements into a plurality of blocks and time-sharingly drives said blocks on a block unit basis;

second information signal lines of wirings as many as the number of said switching elements of one block among said blocks being connected to said driving circuit section;

an information signal output circuit for applying an information signal to said second information signal lines; and an arithmetic operating circuit for correcting the information signal, which is applied to said second information signal line in the previous block near the next block between the previous block which is previously driven and the next block which is driven next when said panel is time-sharingly driven for every block, to an information signal to eliminate a high luminance which is generated in said first information signal line connected to said second information signal line.

2. A liquid crystal panel according to claim 1, wherein said switching elements consist of transistors, said respective transistors are divided into a plurality of blocks, gates of the transistors in each block are commonly wired, and sources of the transistors in each block are connected to said second information signal lines.

3. A liquid crystal panel according to claim 2, wherein said transistors include thin film transistors.

4. A liquid crystal panel according to claim 1, wherein said liquid crystal element includes a device using a ferroelectric liquid crystal.

5. A liquid crystal panel according to claim 1, wherein said liquid crystal element includes a liquid crystal element using an active matrix to drive a twisted nematic liquid crystal by a switching transistor for every pixel.

6. A display panel comprising:

a display section;

an array section of switching elements connected to first information signal lines of said display section, respectively;

a driving circuit section which divides said array section of said switching elements into a plurality of blocks and time-sharingly drives said blocks on a block unit basis;

second information signal lines of wirings as many as the number of said switching elements of one block among said blocks being connected to said driving circuit section;

an information signal output circuit for applying an information signal to said second information signal lines; and an arithmetic operating circuit for correcting the information signal, which is applied to said second information signal line in the previous block near the next block between the previous block which is previously driven and the next block which is driven next when said panel is time-sharingly driven for every block, to an information signal to eliminate a high luminance which is produced in said first information signal line connected to said second information signal line.

7. A display panel according to claim 6, wherein said switching elements consist of transistors, said respective transistors are divided into a plurality of blocks, gates of the transistors in each block are commonly wired, and sources of the transistors in each block are connected to said second information signal lines.

8. A display panel according to claim 7, wherein said transistors include thin film transistors.

9. A liquid crystal display panel comprising:

a liquid crystal display section;

an array of switching elements for sampling/holding which are arranged on the side of video signal lines of said liquid crystal display section by a quantity as many as the number of said video signal lines;

an active matrix circuit which divides said switching element array into a plurality of blocks and time-sharingly drives said blocks;

an external video signal output circuit of output lines as many as the number of signal lines of one block of said switching element array; and an arithmetic operating circuit for eliminating a high luminance line for every block which is produced in a video image.

10. A liquid crystal display panel according to claim 9, wherein said switching elements consist of transistors, said respective transistors are divided into a plurality of blocks, gates of the transistors in each block are commonly wired, and sources of the transistors in each block are connected to said second information signal lines.

11. A liquid crystal display panel according to claim 10, wherein said transistors include thin film transistors.

12. A liquid crystal display panel according to claim 9, wherein said liquid crystal display element includes a display device using a ferroelectric liquid crystal.

13. A liquid crystal display panel according to claim 9, wherein said liquid crystal display element includes a liquid crystal display element using an active matrix to drive a twisted nematic liquid crystal by a switching transistor for every pixel.

14. A method of driving a liquid crystal display panel using:

a liquid crystal display unit;

an array of switching elements for sampling/holding which are arranged on the side of video signal lines of said liquid crystal display unit by a quantity as many as the number of said video signal lines;

an active matrix circuit which divides said switching element array into a plurality of blocks and time-sharingly drives said blocks; and an external video signal output circuit of output lines as many as the number of signal lines of one block of said switching element array, wherein, when said liquid crystal display panel is driven in an alternating current manner at an inversion period of one horizontal period of said liquid crystal display panel, a video signal which was subjected to an arithmetic operating process to eliminate a high luminance line produced in a video image for every block is output to said signal lines from said external video signal output circuit.

15. A driving method according to claim 14, wherein said switching elements consist of transistors, said respective transistors are divided into a plurality of blocks, gates of the transistors in each block are commonly wired, and sources of the transistors in each block are connected to said second information signal lines.

* * * * *

UNITED STATES PATENT AND TRADEMARK OFFICE

CERTIFICATE OF CORRECTION

PATENT NO. : 4,714,921

DATED : December 22, 1987

INVENTOR(S) : HIDEO KANNO, ET AL.

It is certified that error appears in the above-identified patent and that said Letters Patent is hereby corrected as shown below:

COLUMN 1

Line 23, "arrangment" should read --arrangement--.

COLUMN 2

Line 34, "as a" should be deleted.

COLUMN 3

Line 47, "side video" should read --side of video--.

Signed and Sealed this

Twenty-third Day of August, 1988

*Attest:*

DONALD J. QUIGG

*Attesting Officer*

*Commissioner of Patents and Trademarks*